United States Patent [19]

Cur

[11] Patent Number: 4,705,105

[45] Date of Patent: Nov. 10, 1987

[54] LOCALLY INVERTED FIN FOR AN AIR CONDITIONER

[75] Inventor: Ömer N. Cur, St. Joseph Township, Berrien County, Mich.

[73] Assignee: Whirlpool Corporation, Benton Harbor, Mich.

[21] Appl. No.: 860,622

[22] Filed: May 6, 1986

[51] Int. Cl.[4] ..... F28D 1/04

[52] U.S. Cl. ..... 165/151; 165/152

[58] Field of Search ..... 165/151, 152

[56] References Cited

U.S. PATENT DOCUMENTS

| | | | |
|---|---|---|---|
| 2,079,032 | 5/1937 | Opitz | 257/130 |
| 3,003,749 | 10/1961 | Morse | 257/130 |
| 3,796,258 | 3/1974 | Malhotra et al. | 165/151 |
| 4,034,453 | 7/1977 | Tomita et al. | 29/157.3 L |
| 4,038,061 | 7/1977 | Anderson et al. | 62/126 |
| 4,300,629 | 11/1981 | Hatada et al. | 165/151 |
| 4,365,667 | 12/1982 | Hatada et al. | 165/152 |
| 4,434,844 | 3/1984 | Sakitani et al. | 165/151 |
| 4,469,167 | 9/1984 | Itoh et al. | 165/151 |
| 4,469,168 | 9/1984 | Itoh et al. | 165/152 |
| 4,480,684 | 11/1984 | Onishi et al. | 165/110 |
| 4,593,756 | 6/1986 | Itoh et al. | 165/151 |

FOREIGN PATENT DOCUMENTS

| | | | |
|---|---|---|---|
| 56-23699 | 3/1981 | Japan | 165/151 |
| 57-37696 | 3/1982 | Japan | 165/151 |
| 60-60495 | 4/1985 | Japan | 165/151 |

*Primary Examiner*—Albert W. Davis, Jr.
*Assistant Examiner*—Richard R. Cole
*Attorney, Agent, or Firm*—Lowe, Price, LeBlanc, Becker & Shur

[57] ABSTRACT

A generally corrugated fin of a finned tube heat exchanger is formed to have a plurality of cylindrical collars that fit closely around tubes containing a first fluid, for good thermally conductive contact therewith. The collars are arrayed in rows along the corrugations and, within each local fin region between adjacent collars, cuts are provided parallel to and between adjacent crests and troughs, with a portion of each crest locally inverted to form a local trough and each trough inverted to form a local crest between successive cuts. A second fluid flowing outside the tubes between adjacent fins is thereby enabled to form numerous short boundary layers and to flow from one side of each fin to the other, thereby promoting turbulence and flow-mixing that enhance heat transfer between the two fluids. In a preferred embodiment of the fin, two parallel local cuts are provided between each crest and trough and the strip between each pair of cuts is formed into a louver having a substantial portion parallel to the closest surface of the adjacent inverted local crest and trough on either side.

15 Claims, 11 Drawing Figures

Fig. 1
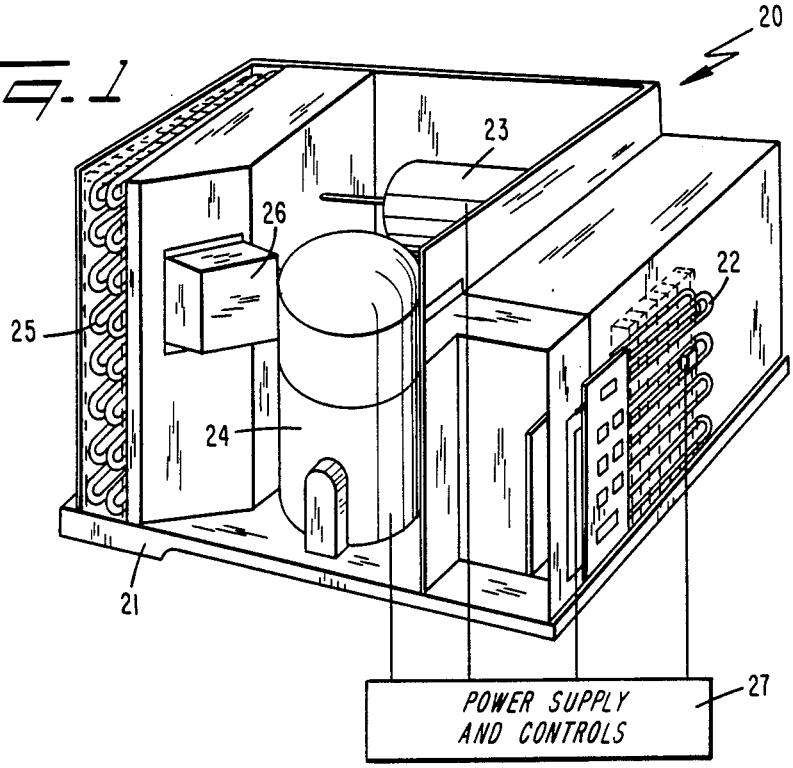
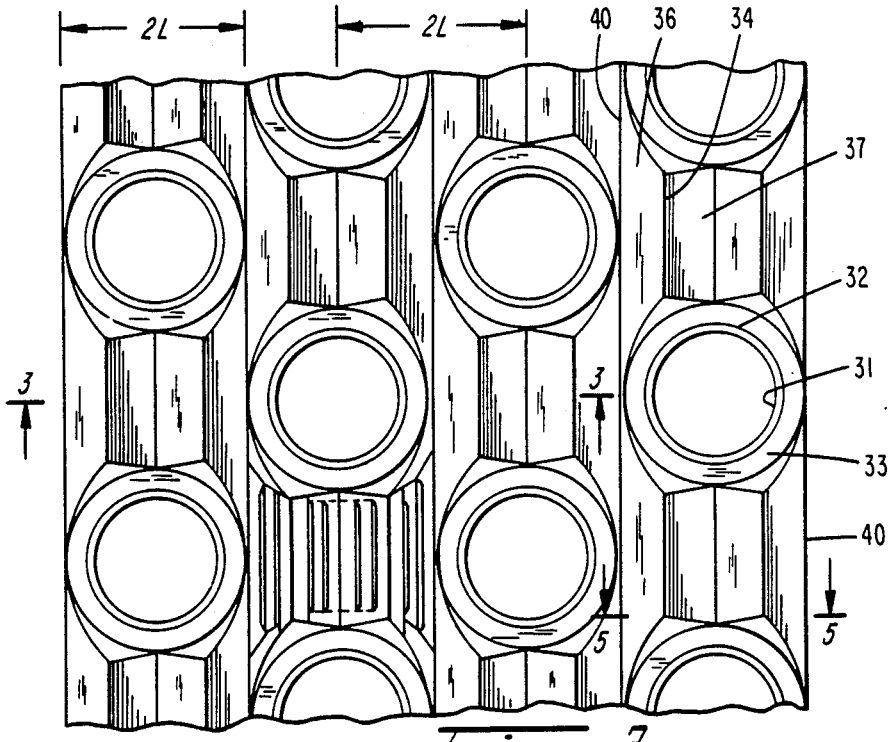
Fig. 2

LOCALLY INVERTED FIN FOR AN AIR CONDITIONER

TECHNICAL FIELD

This invention relates to improvements in the configuration of the fin element of a finned tube heat exchanger of the type utilized as a condenser in a space cooling device such as a typical room air conditioner.

BACKGROUND OF THE INVENTION

At the heart of the typical space or room air conditioning system is a combination of electromechanical elements that work together on a refrigerant fluid, e.g., one of the Freon (TM) compounds, according to a refrigeration cycle. Typically, the Freon vapor is compressed by an electrically driven compressor and the compressed vapor is cooled by being passed through a heat exchanger, commonly known as a condenser, after which it is throttled and passed through a second heat exchanger where it picks up heat from air within the building. The refrigerant is then returned to the compressor to undergo the cycle once again.

Most conventional heat exchangers generally consist of a nest of tubes made of a thermally highly conductive metal like copper, to which are attached numerous thin metallic fins which conduct away heat from the tubing to transfer it to air-flow directed between and over the fins. A motor driven fan typically directs air-flow through the fins surrounding the nested tubes. To reduce both the cost of the structure and the power requirements of the fan directing the air-flow through the heat exchanger, it is important to maximize the rate at which the refrigerant fluid flowing through the tubes transfers heat to or from the air flowing past the tubes and between the fins, i.e., the "air-side heat transfer", while keeping the air flow pressure drop through the heat exchanger low.

One solution is to increase the total area of the fins by increasing the number of fins to obtain increased transfer of heat by forced convection to the air flowing therebetween. This, however, soon diminishes the size of the passages between the fins through which the air must flow and will require a more powerful fan to provide the pressure difference to force the desired amount of air flow through the fins. A second alternative is to provide reasonably spaced-apart fins having a waffle-like or undulating configuration to increase the area exposed to the air flow. Unfortunately, with this latter solution, a problem arises in the growth of velocity and heat transfer boundary layers which very soon diminish the amount of heat transfer that can take place between the flowing air and the fin surfaces. In recognition of this problem, designers of heat exchangers have focused on techniques to inhibit the growth of velocity and heat transfer boundary layers while increasing flow mixing and turbulence without significantly increasing the overall pressure difference required to obtain the desired flow of air through the tube and fin assembly.

Heat transfer by conduction must first occur between the surface of the refrigeration-carrying tubing and the fins and, thereafter, by convection from the fin surfaces to the air flowing between the fins. There is also a direct transfer of heat from the surface of the tubing by convection to the air flowing past the tubing, but this generally amounts to a relatively small fraction of the overall heat transfer.

U.S. Pat. No. 2,079,032, to Opitz, discloses corrugated edges on fins to strengthen the fins, as well as fin portions that form substantial angles at the tube collars where the tubes pass through the fins, with the focus being on the corrugated fin construction to strengthen the assembled heat exchanger against crushing forces. U.S. Pat. No. 4,480,684, to Onishi et al., teaches the use of offset tube collars in the fins, with the fins themselves lanced in offset bridgelike formations, each of which is substantially parallel to the fin corrugation thereat. U.S. Pat. No. 4,469,168, to Itoh et al., discloses enhanced heat transfer fins that have series of louvers, inclined at a small angle to the direction of flow of the cooling air in a direction opposite to that of the inclination of the fins and intersecting the fins locally. U.S. Pat. No. 4,469,167, also to Itoh et al., discloses enhanced fins having series of louvers offset above and below the plane of the fin and all inclined at the same predetermined angle to the direction of the air flow past the fins. U.S. Pat. No. 4,300,629, to Hatada et al., discloses enhanced fins having pluralities of peaked bridge-like portions without peak inversions. U.S. Pat. No. 3,003,749, to Morse, discloses a serpentine automotive radiator fin strip with alternating peaks and flat-bottomed troughs partially separated by lanced fins intersecting the parent fin surface. All of the above-mentioned patents offer solutions intended to increase the turbulence in the air flow to inhibit the growth of velocity and heat transfer boundary layers on the fin surface, thereby to ensure a higher efficiency in the heat exchanger.

The complex turbulent air flow through the heat exchanger does not lend itself to comprehensive theoretical analyses. Hence, there is a need for design improvements in heat exchanger fins whereby well-understood theoretical principles are applied in logical fashion to obtain improved heat transfer, e.g., by providing numerous leading edges and short streamwise surfaces to generate short-lived velocity and thermal boundary layers, louvers to create flow across fins, and the like.

DISCLOSURE OF THE INVENTION

Accordingly, it is an object of this invention to provide a fin configuration in a finned tube heat exchanger for improving the heat transfer from the tubes containing one fluid to fins over which a second fluid flows.

It is a further object of this invention to provide a fin configuration in a finned tube heat exchanger for improving the heat transfer by forced convection from the fins to a fluid flowing between, over and through the fins.

It is a related further object of this invention to provide fin configurations which improve heat transfer from the fins to a fluid flowing between, over and through the fins by inhibiting the growth of velocity and boundary layers at the fin surface.

These and other related objects of this invention are achieved by providing in a generally corrugated fin of a finned tube heat exchanger a plurality of cylindrical collars that fit closely around tubes containing a first fluid and, in each crestwise local span of the fin extending between adjacent collars in a row of collars, a first cut between each crest and trough of the corrugation. Between adjacent cuts, within this local span each crest is inverted into a local trough and each trough is inverted into a local crest, thus opening passages therebetween to enable the second fluid to flow from one side of the fin to the other. In another aspect of the invention, a second cut is provided parallel to each of the first cuts, defining a strip formed into a louver between successive local troughs and local crests and aligned to be parallel to their closest adjacent surfaces. The louvers further enhance flow mixing and promote additional heat transfer from the fin to the second fluid.

BRIEF DESCRIPTION OF THE DRAWINGS

FIG. 1 is a schematic perspective view of a typical air conditioner.

FIG. 2 is a plan view of a basic corrugated fin, of which one span between adjacent collars is formed according to this invention.

BEST MODE FOR PRACTICING THE INVENTION

Figure 3:
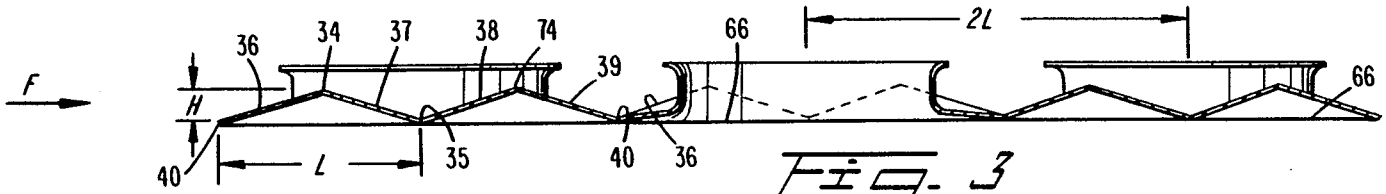
FIG. 3 is an elevation view at section 3—3 in FIG. 2.

A typical space cooling device 20, e.g., a room air conditioner as illustrated in FIG. 1, includes a conventional compressor 24, condenser 25 and heat sink 26, interconnected through tubing to an evaporator 22 to effect the flow of a refrigerant fluid therethrough. Air is cooled as a result of being passed in a heat exchange relationship with evaporator 22. Heat transfer is obtained between the refrigerant fluid, flowing through the thermally conducting tubes of evaporator 22 and condenser 25, and air cooled by being directed by a fan 26 past these tubes and their associated fins. This cooled air may be directed into the room via ducting (not shown) and the heat removed from the room is rejected to the atmosphere via condenser 20.

The operation of such an air conditioning system is usually controlled by a user-set thermostat control and power supply 27 disposed at a suitable location, preferably within the residence. The present invention addresses the need to provide fin configurations for improved heat transfer from fluid flowing in the tubes of either condenser 34 or evaporator 22 so as to minimize the cost of installing and operating such a system.

A typical finned tube heat exchanger is generally assembled by stacking the fins, typically having a corrugated or waffle-type configuration, inserting the tubes through the fins and mechanically expanding the tubes to make good physical contact with each fin. Conductive heat transfer then takes place between the exterior of each tube and the collars formed around the openings in the fins.

Figure 7:
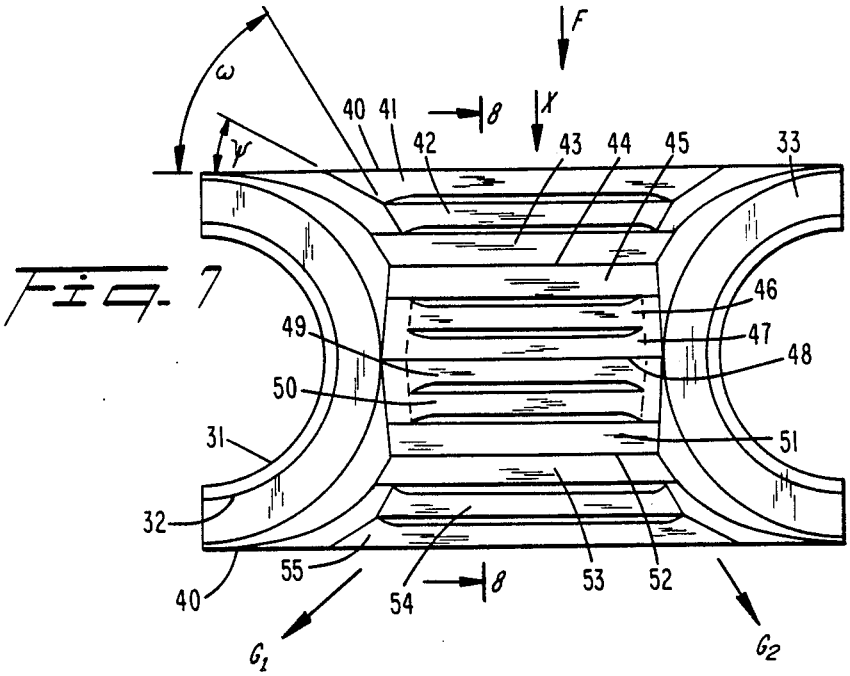
FIG. 7 is a plan view of a typical local span of the fin extending between the centers of two collars according to one aspect of this invention.

The symmetrical nesting of the tubes in typical condenser 25 and typical evaporator 22, best seen in FIG. 1, is obtained by locating the neighboring tubes inside collars that are generally symmetrically disposed in the fin surface. Because of the substantial symmetry in the layout of the tubes and the fins within each heat exchanger, as best seen in FIGS. 1 and 2, it is sufficient to examine only that local span of the fin element which lies between adjacent tubes and which is repeated again and again in the overall symmetrical pattern. FIG. 7, therefore, presents only that local element of the fin element which extends between the center lines of two adjacent tubes passing through the collars 31 and extending laterally thereof between vertical lines that define the plane separating two adjacent tubes in the lateral direction. In FIG. 7, only the fin element is shown and the tubes that would pass through the collar regions are omitted for simplicity.

Figure 5:
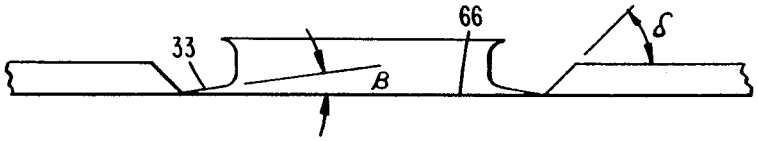
FIG. 5 is an elevation view at section 5—5 in FIG. 2.

As is best seen in FIG. 3, which is a section at 3—3 of FIG. 2, the basic corrugated fin element itself has a pleated shape resembling a shallow letter "M" of which the separate elements are 36, 37, 38 and 39. For ease of reference, a nominally "horizontal" plane 66 passing through the crests on one side of the basic corrugated shape of the fin is used as a datum for measuring angles and distances in the following discussion. Within these elements of the fin structure is formed a collar having a cylindrical portion 31 vertical with respect to reference plane 66 and a turned upper edge 32. The cylindrical portion 31 is then faired into a shallow conical circular annular zone 33, as best seen in FIGS. 2 and 5. This shallow conical annular zone 33 is deliberately formed to be at a shallow angle "$\beta$" with respect to the baseline 66 of collar 31. Experimental evidence indicates that a value of $\beta$ approximately equal to 6° generates substantial heat transfer benefits, although the precise theoretical reasons for this are not well understood because of the complex geometry and air flows that prevail in this region during normal operating conditions.

Still referring to FIGS. 2 and 3, it is useful to focus attention on the amount of fin surface within the local portion lying in the crestwise direction between two neighboring collar centers and lying in the direction laterally thereof between two troughs a distance 2L apart between successive corrugation lines 40. The basic corrugation for this local element extends from a trough at 40 (at the extreme left in FIG. 3) as a first corrugated element 36 to a first crest 34 followed, in sequence, by second corrugation element 37 to trough 35, a third corrugation element 38 to a second crest 74, a fourth corrugation element 39 and the next line 40 defining the lateral boundary of the local element of the fin that is of immediate interest. The height of the corrugation from peak to crest is H, as best seen in FIG. 3. This local element of the fin is typical and is repeated numerous times in a typical finned tube heat exchanger.

The intended improvement in heat transfer between each fin surface and the air-flow between adjacent fins is obtained in this invention, inter alia, by (a) frequent changes in the direction of air-flow due to local inversions of troughs and crests; (b) enablement of air-flow across the average throughflow due to the provision of numerous openings between local crests and troughs where the cuts were made in the basic corrugation; (c) provision of numerous leading edges at the local troughs and crests; and (d) repeated termination of the continuity of boundary layer forming surfaces.

Figure 8:
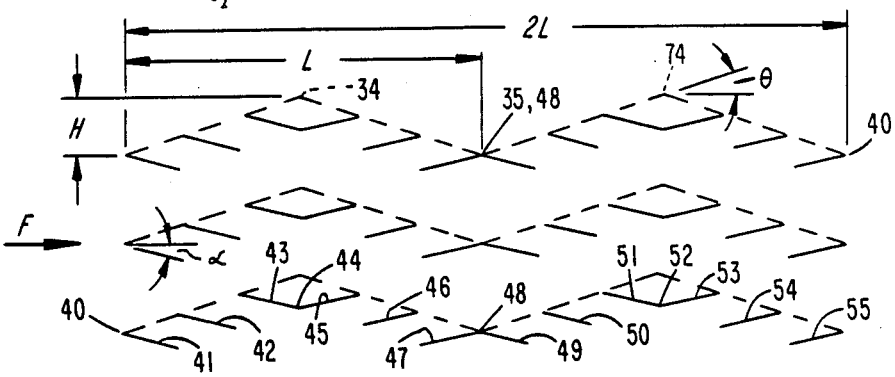
FIG. 8 is a simplified elevation view at section 8—8 in FIG. 7.

All of the above heat transfer enhancing mechanisms are realized in a preferred embodiment of the invention—best understood with reference to FIGS. 7 and 8—in which two cuts are provided between each crest and trough of the basic corrugated pattern, and in which the fin surface between the cuts is formed into a louver between each pair of local trough and local crest after local inversion of the fin surface as before. Referring now to FIG. 8, the local element of the fin in this embodiment has a profile, between neighboring boundary lines 40, comprising (in the direction of arrow F) a local crest 40 with surface elements 41 and 55 and a louver 42 having an upstream edge still coincident with the original corrugation surface but having an inclination parallel to surface 41 of the closest local crest 40. A local trough 44 is defined by surface elements 43 and 45, of which surface 43 is parallel to surfaces 41 and 42. Louver 46, further downstream, is parallel to the surface 45 of the closest locally inverted trough 44. This is followed, in the streamwise direction of arrow F, by a local crest 48 which has surfaces 47 and 49, of which surface 47 is parallel to louver 46 and surface 45, and surface 49 is parallel to surfaces 41, 42 and 43. This is followed by a structure comprised of surfaces 49 through 55, disposed downstream thereof.

An intended advantage of the inventive structure is that numerous relatively short edges are now introduced where numerous velocity and thermal boundary layers are started but which cannot grow very thick due to the relatively short streamwise span of each surface element before the next flow disturbance. As persons skilled in the art will readily appreciate, heat transfer to a fluid occurs at a relatively high rate when the velocity and thermal boundary layers are thin, i.e., if their thicknesses are not allowed to grow. Boundary layer growth is inhibited by providing interruptions in the local streamwise continuity of the surface to which these boundary layers are attached.

Figure 11:
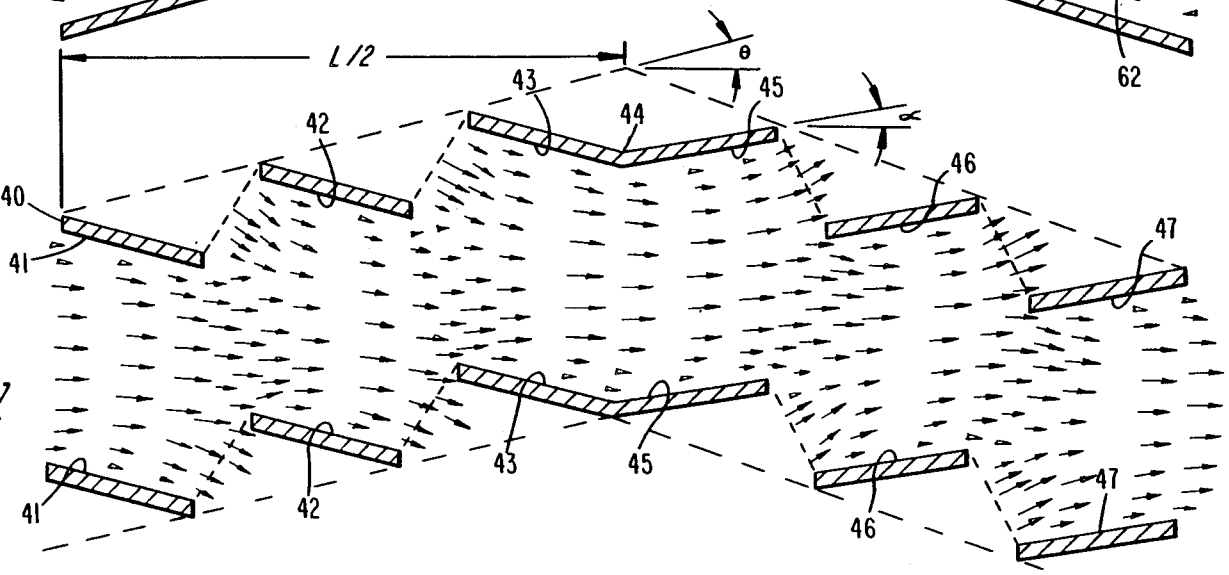
FIG. 11 is a computer-generated plot depicting a flow pattern between two adjacent corrugated fin surfaces formed according to one embodiment of this invention.

Flow reaching leading edges of locally inverted troughs and crests and the louvers therebetween is split to opposite sides, as best presented in FIG. 11. From the same figure, it is also apparent that flows passing trailing edges of locally inverted troughs and crests and the louvers from both sides of the fins mingle locally. This causes frequent and intense mixing of flows, limits boundary layer growth, and provides effective turbulent heat transfer with very little flow stagnation anywhere. The key here is that surfaces encountered by the air flow change their inclinations frequently, have short streamwise lengths, are disposed so as to split and recombine flows from both sides, and serve to reduce flow stagnation regions near the tubes and collars.

Figure 4:
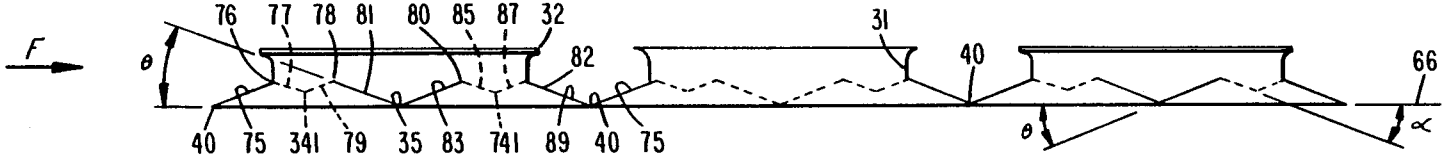
FIG. 4 is an elevation view of a corrugated fin partially formed according to this invention.

With reference to FIGS. 4 and 8 it should be noted that the basic corrugation for a fin with plane elements (straight sides 36–39 in FIG. 3) has its elements inclined at a first angle $\theta$ to either side of reference plane 66. Also, in forming local surface inversions, in both the first and the second (louvered) embodiment the locally inverted plane surfaces and the plane louvers are inclined at a second angle $\alpha$ to either side of reference surface 66. Experimental evidence indicates that a value of $\theta$ in the range 8° to 20° and a value of $\alpha$ in the range 0° to 20°, as defined above, provides significantly enhanced heat transfer relative to the heat transfer obtained with the basic corrugated fin shape.

Figure 6:
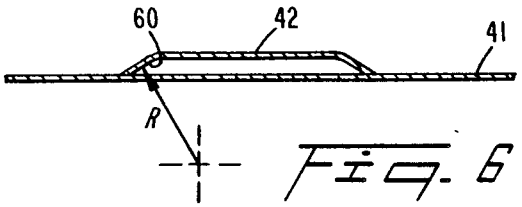
FIG. 6 is a view, in the direction of arrow X in FIG. 4, of a louver edge.

As a practical matter, it is not necessary that the basic corrugated shape be formed of flat planar segments, i.e., the peaks and troughs as well as the surfaces between them may be rounded. Likewise, it is not necessary that the basic corrugation be formed, cut and reformed for local inversions in any particular order, i.e., a thin flat sheet with cuts may be formed to the final desired shape by any known sheet metal forming techniques. As indicated in FIG. 6, it is convenient to form the louvers such that a substantial central portion thereof has a straight edge form with rounded ends blending into the parent surface.

As illustrated in FIGS. 5 and 7, the fairing-in of the collars 31 (and the shallow annular conical zones 33 around them) into the fin corrugations may be done by piecewise surface changes, e.g., with lines of contiguity inclined at angles $\omega$ and $\psi$ with respect to reference line 40 and at inclination $\delta$ with respect to reference plane 66, as applicable.

A further benefit of the preferred embodiment configuration may be appreciated with reference to FIG. 7. As air flows in the average throughflow direction per arrow F and passes over surfaces 54 and 55 it has local flow components along these surfaces and also has components laterally with respect to the direction of arrow F (see local flow direction arrows $G_1$ and $G_2$). A beneficial consequence of this is that there is a scouring effect around the extreme downstream portion of each collar (and the tube contained within) instead of a "dead zone" with low heat transfer rates. Thus the configuration according to this invention allows very effective utilization of all available heat transfer surfaces of both the fins and the tubes by multi-directional throughflow.

Figure 9:
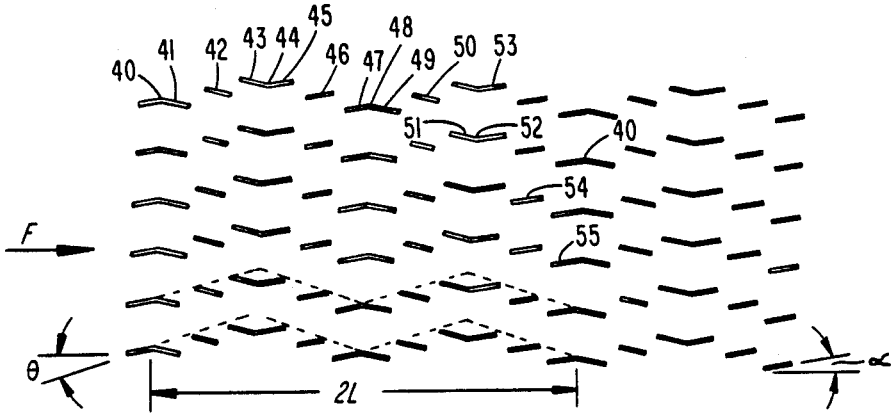
FIG. 9 is a computer-simulated elevation view at section 8—8, for flow velocity simulation.

FIG. 9 is a graphic illustration of the geometry utilized in a numerical computer simulated analysis of air-flow through the louvered embodiment of this invention. Because of certain numerical constraints in the computer simulation program, there are slight F-directional discontinuities in the fin surfaces between fin segments (FIGS. 9 and 11) as the flow moves from local crest 4 to louver 42 to local trough 44, and on further downstream. This is not significant as it was done solely to facilitate numerical calculations. The predicted numerical results, in fact, apply quite well to the utilized surfaces as more realistically depicted in FIG. 8.

Figure 10:
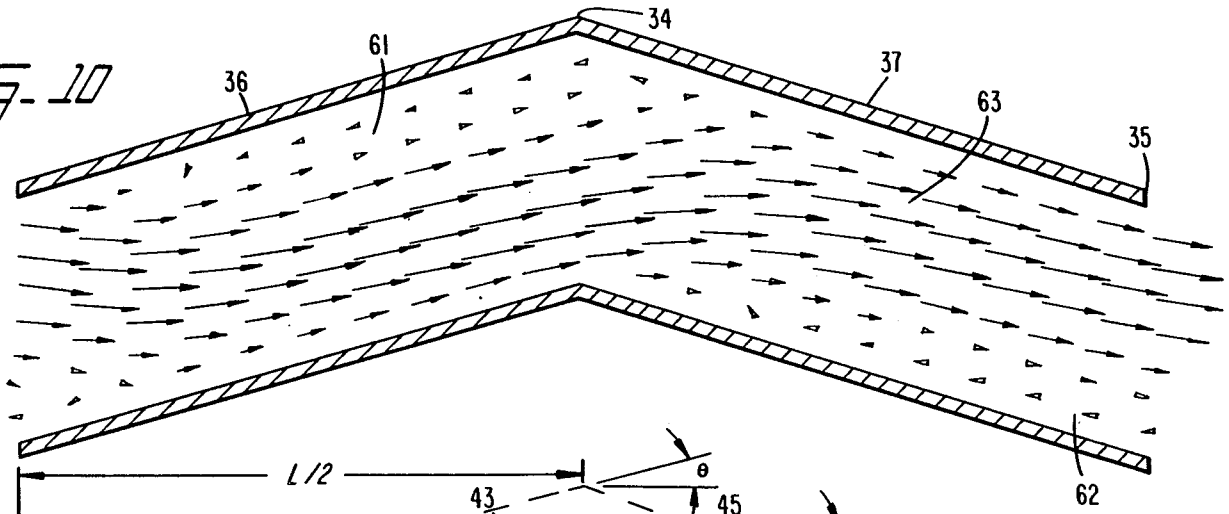
FIG. 10 is a computer-generated plot depicting a flow pattern between portions of two adjacent corrugated fin surfaces.

FIG. 10 presents a computer generated flow velocity distribution plot in a peak region of a basic planar corrugation region between neighboring fines between two adjacent collars, i.e., local effects due to near-collar geometry are not significant. It is evident that due to local low-velocity flow reversals, in regions 61 and 62, the bulk of the through flow effectively streams away from the fin surfaces, across a reduced cross-section normal to the local streamlines 63.

By comparison, as best seen in FIG. 11, when the geometry of the louvered embodiment is utilized for a similar computer simulation, it is clear that the numerous short surfaces and flow direction changes promote flow mixing and relatively small regions of low velocity flows. Such flows have been experimentally determined to be associated with favorable heat transfer rates. A compact heat exchanger incorporating enhanced fins having the geometry of the louvered and locally inverted fin embodiment of FIG. 8 was evaluated experimentally on a coil calorimeter. The test results showed significant improvement in the heat transfer coefficient values when compared with results obtained from a similar test on a heat exchanger incorporating only the standard wavy (corrugated) fins.

It should be apparent from the preceding that this invention may be practiced otherwise than as specifically described and disclosed herein. Hence modifications may be made to the specific embodiments disclosed here without departing from the scope of this invention and are intended to be included with the claims appended below.

What is claimed is:

1. In a finned heat exchanger unit, wherein heat transfer takes place between a first fluid flowing through a plurality of spaced-apart finned tubes and a second fluid flowing outside the finned tubes, a plurality of fins, each fin comprising:

a thin sheet of a heat conductive material formed into corrugations of predetermined pitch L and height H, comprising a plurality of crests peaked in a first direction alternating with a plurality of troughs peaked in a second direction opposite said first direction;

said thin sheet being also formed to have a plurality of substantially cylindrical collars therethrough, with the centers of said collars aligned with said troughs, each collar having a shape and size to closely fit around one of said plurality of heat exchanger tubes for conductive heat exchange therewith; and within a local element of said fin, extending between the centers of a streamwise neighboring pair of said plurality of collars, said thin sheet being further provided with a plurality of parallel first and second cuts, between each pair comprised of a crest and an adjacent trough, whereby a strip of said thin sheet is defined between each pair of said first and second cuts between each pair comprised of a local crest and an adjacent local trough, with each one of said crests and troughs between adjacent strips being locally inverted such that a portion of each crest is locally inverted into a local trough and a portion of each trough is locally inverted into a local crest, said strips being formed into louvers each having a substantial portion thereof formed intermediate to and aligned parallel with the closest portions of said adjacent inverted local crest and local trough, respectively.

2. In a finned-tube heat exchanger unit, a fin according to claim 1, wherein:

said thin sheet is shaped around said collar in the form of a shallow conical annular zone surface inclined with respect to a plane normal to the axis of the within cylindrical collar at a predetermined angle $\beta$ and peripherally faired into said corrugated thin sheet.

3. In a finned-tube heat exchanger unit, a fin according to claim 1, wherein:

each one of said louvers is symmetrically disposed with respect to the symmetrically shaped adjacent local crest and local trough, respectively, on either side thereof.

4. In a finned-tube heat exchanger unit, a fin according to claim 3, wherein:

said corrugations are formed of like planar segments between said peaked crests and troughs, said planar segments being alternately inclined each at a predetermined first angle $\theta$ measured on opposite sides of the plane of symmetry of said corrugations;

a substantial portion of each of said local troughs and local crests is defined by two intersecting flat planes each respectively inclined with respect to said plane of symmetry at a predetermined second angle $\alpha$ measured on opposite sides thereof; and one edge of each louver is coincident with the planar corrugation segment from which that louver is formed, and a substantial portion of each louver is planar and inclined at said second angle $\alpha$ with respect to said plane of symmetry.

5. In a finned-tube heat exchanger unit, a fin according to claim 4, wherein:

said thin sheet is shaped around said collar in the form of a shallow conical annular zone surface inclined with respect to a plane normal to the axis of the within cylindrical collar at a predetermined angle peripherally faired into said corrugated thin sheet.

6. In a finned-tube heat exchanger unit, a fin according to claim 5, wherein:

said predetermined angle $\theta$ is in the range of 8° to 20°.

7. In a finned-tube heat exchanger unit, a fin according to claim 5, wherein:

said predetermined angle $\alpha$ is within the range 0° to 20°.

8. In a finned-tube heat exchanger unit, a fin according to claim 5, wherein:

said predetermined angle $\alpha$ is approximately 17°; and said predetermined angle $\alpha$ is approximately 12°.

9. In a finned-tube heat exchanger unit, a fin according to claim 4, wherein:

said collars are evenly spaced apart within each row in a plurality of rows;

said rows are spaced apart from each other by a streamwise distance 2L, with the centers of said collars within each row being located along every other one of said troughs; and successive rows are staggered lengthwise to provide an even disposition of said collars in said fin.

10. In a finned-tube heat exchanger unit, a fin according to claim 9, wherein:

said thin sheet is shaped around said collar in the form of a shallow conical annular zone surface inclined with respect to a plane normal to the axis of the within cylindrical collar at a predetermined angle $\beta$ and peripherally faired into said corrugated thin sheet.

11. In a finned-tube heat exchanger unit, a fin according to claim 10, wherein:

said thin sheet is shaped around said collar in the form of a shallow conical annular zone surface inclined with respect to a plane normal to the axis of the within cylindrical collar at a predetermined angle $\beta$ and peripherally faired into said corrugated thin sheet, and said conical annular zone is totally contained with said 2L distance separating adjacent rows of collars.

12. In a finned-tube heat exchanger unit, a fin according to claim 11, wherein:

said predetermined angle $\theta$ is in the range 8° to 20°.

13. In a finned-tube heat exchanger unit, a fin according to claim 11, wherein:

said predetermined angle $\alpha$ is within the range 0° to 20°.

14. In a finned-tube heat exchanger unit, a fin according to claim 11, wherein:

said predetermined angle $\beta$ is approximately 6°.

15. In a finned-tube heat exchanger unit, a fin according to claim 14, wherein:

said predetermined angle $\theta$ is approximately 17°; and said predetermined angle $\alpha$ is approximately 12°.

* * * * *